US005892294A

United States Patent [19]

Reid

[11] Patent Number: 5,892,294

[45] Date of Patent: Apr. 6, 1999

[54] MODULAR AUTOMOTIVE RACING SIMULATION APPARATUS

[76] Inventor: Dennis Reid, 107 Rodeo Ct., Lafayette, Calif. 94523

[21] Appl. No.: 884,183

[22] Filed: Jun. 27, 1997

Related U.S. Application Data

[63] Continuation-in-part of Ser. No. 272,227, Jul. 8, 1994, Pat. No. 5,804,885.

[51] Int. Cl.[6] ..... H01H 43/04

[52] U.S. Cl. ..... 307/10.1

[58] Field of Search ..... 307/9.1, 10.1, 307/157; 273/445, 455; 463/6, 35

[56] References Cited

U.S. PATENT DOCUMENTS

| | | | |
|---|---|---|---|
| Re. 32,474 | 8/1987 | Reid | 307/10.1 |
| 4,373,722 | 2/1983 | Kite et al. | 463/35 |
| 4,846,467 | 7/1989 | Rosson | 273/445 |
| 5,804,885 | 9/1998 | Reid | 307/10.1 |

OTHER PUBLICATIONS

Declaration of Dennis Reid; Nov. 9, 1994.

May 7, 1993 advertisement for a Practice Tree.

Apr., 1993 article re: Making Your Holeshots at Home, Bill Auda.

*Primary Examiner*—Richard T. Elms

*Attorney, Agent, or Firm*—Limbach & Limbach L.L.P.

[57] ABSTRACT

An automotive racing simulation apparatus has an electronic controller which controls a series of Christmas lights each of which is separately activatable. In addition, the electronic controller controls a sound generator, which can be modularly electrically connected to the electronic controller and is activated immediately prior to the activation of the Christmas lights to more realistically simulate automotive racing conditions.

14 Claims, 18 Drawing Sheets

| Fig. 3b-1 | Fig. 3b-2 | Fig. 3b-3 | Fig. 3b-4 |
|---|---|---|---|

Key To

MODULAR AUTOMOTIVE RACING SIMULATION APPARATUS

This is a continuation-in-part application of application Ser. No. 08/272,227 filed on Jul. 8, 1994, now U.S. Pat. No. 5,804,885.

TECHNICAL FIELD

The present invention relates to an automotive racing simulation apparatus and more particularly to a racing simulation apparatus of the type known as "practice Christmas tree" incorporating sound generating means for simulating more realistically the sound and noise of an automotive racing track.

BACKGROUND OF THE INVENTION

In automotive racing, typically known as "drag racing" two cars line up side-by-side, on a starting line, with each car in a track lane. A series of starting lights are mounted on a "Christmas tree" which are illuminated sequentially and count down until a green light appears. The illumination of the green light signals the start of a race. The racers take off on the starting line and then race to the end of the track which consists of a straight two lane road, usually up to one-quarter mile in length. The object is to get the cars to accelerate as quickly as possible so as to be the first one to cross the finish line. The elements that comprise a winning race is the combination of the time it takes for a car to run the length of the race course plus the amount of time it takes for the driver to react to the starting lights.

The series of lights, called a "Christmas tree" is located in the center of the two lanes between the two race cars near the starting line. The "Christmas tree" contains a number of lights which typically consists of a pre-stage light, a stage light, a series of count down lights, which number from 1 to 5 amber lights, and then finally a green light. A red light is also provided for each lane and is illuminated when there is a foul. The pre-stage lights indicate to the driver that the driver is near the starting line and the stage lights tell the driver that the driver is actually on the starting line.

A building located near the starting line, called the timing tower, contains an electronic control box which times the race cars and also controls the Christmas tree. When the track official who is located at the starting line activates a switch that signals the electronic control box, the electronic control box starts a count down sequence on the Christmas tree of the count down lights, i.e. amber lights, in a precisely timed pattern eventually ending up with the green light at the end of sequence. The racers may drive away from the starting line any time after the racer's respective green light comes on. If the racer activates too soon, a foul start or a red light is indicated, meaning that the driver is disqualified from the race. To start the car moving, the driver either releases the brakes on the car or releases a switch that allows the car to take off from the starting line. Clearly, the optimal starting moment is to have the car leave the starting line at exactly the instant that the green light is activated.

Since starting time is so critical, electronic practice aids known as practice Christmas trees are known from the prior art. These practice Christmas trees are either full size Christmas trees or are miniature versions thereof which flash the count down lights. The user reacts to the green light by activating a switch, like the switch that starts a car. The device measures the response time, typically known as "reaction time" and then displays the time in some sort of digital readout. The closer to the race track conditions, the more realistic the training exercise would be. With better timing, better results would occur in terms of winning at the race track.

One shortcoming of the prior art practice Christmas tree is the absence of sound and/or noise simulating race track conditions. Race cars create loud and distinctive sounds compared to passenger cars and this can be distracting to many drivers. However, it is not desirable, for a driver to avoid the distraction of the engine noises by, for example, wearing ear plugs at the race track so that the race track conditions are closer to the practice conditions. This is not a viable solution for a number of reasons. The most important reason is that the exhaust sounds of an engine are so loud that the ear plugs muffle the noise but do not silence it. In addition, as part of a successful racing program, it is essential for the driver to provide feedback to the mechanics on the performance of the engine as detected by the noise. The driver does this by listening to the engine, drive train and the car itself as the run is made. This helps the driver and the mechanic diagnose performance related problems. Muffling the sound as the driver initiates racing conditions would be detrimental to the racing program.

In some forms of drag racing, the electronic control box, located in the timing tower, delays the start of the count down lights on one side of the Christmas tree, so that one of the drivers is given a "handicap". The handicap consists of a certain amount of time by which the slower car is permitted to leave the starting line. This control box is programmed with the respective elapsed time expected for each car which then determines the amount of handicap (the difference between the elapsed times) by which the slower car is allowed to leave before the faster car.

Because the reaction time of a driver to activate the switch that starts a vehicle, is so critical to the performance in starting a vehicle, in the prior art, delay boxes, such as that disclosed in U.S. Pat. No. 4,467,219, are well known. A driver inputs an amount of reaction delay time into the delay box. The user would activate the switch on the delay box immediately upon perceiving the occurrence of the first of the plurality of count down lights indicating a count down to the green light. The delay box would count down based upon the amount of delay time inputted by the driver, and upon the end of the delay time period, the vehicle would be started. The amount of reaction delay time inputted by the driver into the delay box would equal the amount of time normally attendant to the count down of the lights, and the reaction of the driver in activating the switch on the delay box. Thus, a driver can program the delay box to start a vehicle more consistently.

Finally, in the prior art, it is known to provide a cross-over delay box. With a cross-over delay box, the driver of a faster vehicle ("faster driver") at a race track can program each car's expected elapsed time and also program the amount of reaction time delay of the faster driver. Thus, a faster driver would typically initiate the cross-over delay box as soon as the faster driver sees the slower driver's first amber light illuminated. The cross-over delay box would compute the amount of time that is attributable to the handicap and the reaction time delay of the faster driver activating the cross-over delay box thereby releasing the engine brakes hopefully at the same time as the green light of the faster driver is illuminated. Although cross-over delay boxes are know and have been used at races, they have not been incorporated or used in a practice Christmas tree device.

SUMMARY OF THE INVENTION

In the present invention, an automotive racing simulation apparatus has a visual indicator means having a plurality of discrete, separately activatable display means for visually indicating the commencement of an automobile race. An electronic means separately activates each of the display means in sequence. Finally, a sound generating means which is activatable by the electronic means, generates sound representative of the automobile race, prior to its start and concurrent with the activation of the plurality of display means. The sound generating means is electrically connectable to and detachable from the electronic means.

BRIEF DESCRIPTION OF THE DRAWINGS

FIG. 2*a*-1 through 2*a*-2 comprise a schematic block level diagram of a portion of the simulation apparatus shown in FIG. 1 for setting the amount of time delay to be processed by the apparatus of the present invention.

FIG. 2*b*-1 through 2*b*-2 comprise a schematic block level diagram of a portion of the racing simulation apparatus of FIG. 1 showing a plurality of switches for operating the apparatus of the present invention in various modes, including a cross-over delay mode, and connection to track photocells if used in place of switch inputs, and a power supply and filter.

FIGS. 2*c*-1 through 2*c*-2 comprise a schematic block level diagram of the electronic controller portion of the racing simulation apparatus shown in FIG. 1.

FIGS. 2*d*-1 through 2*d*-3 comprise a schematic block level diagram of a plurality of Christmas tree lights and digital display that are activatable by the electronic controller shown in FIGS. 2*c*-1 through 2*c*-2.

FIGS. 2*e*-1 through 2*e*-3 comprise a schematic block level diagram of a sound generator activatable by the electronic controller shown in FIGS. 2*c*-1 through 2*c*-2, and external tree and time display driver circuit.

FIG. 3*a* and FIGS. 3*b*-1 through 3*b*-4 comprise a flowchart of the software used in the microcomputer portion of the apparatus of the present invention.

DETAILED DESCRIPTION OF THE DRAWINGS

Figure 1:
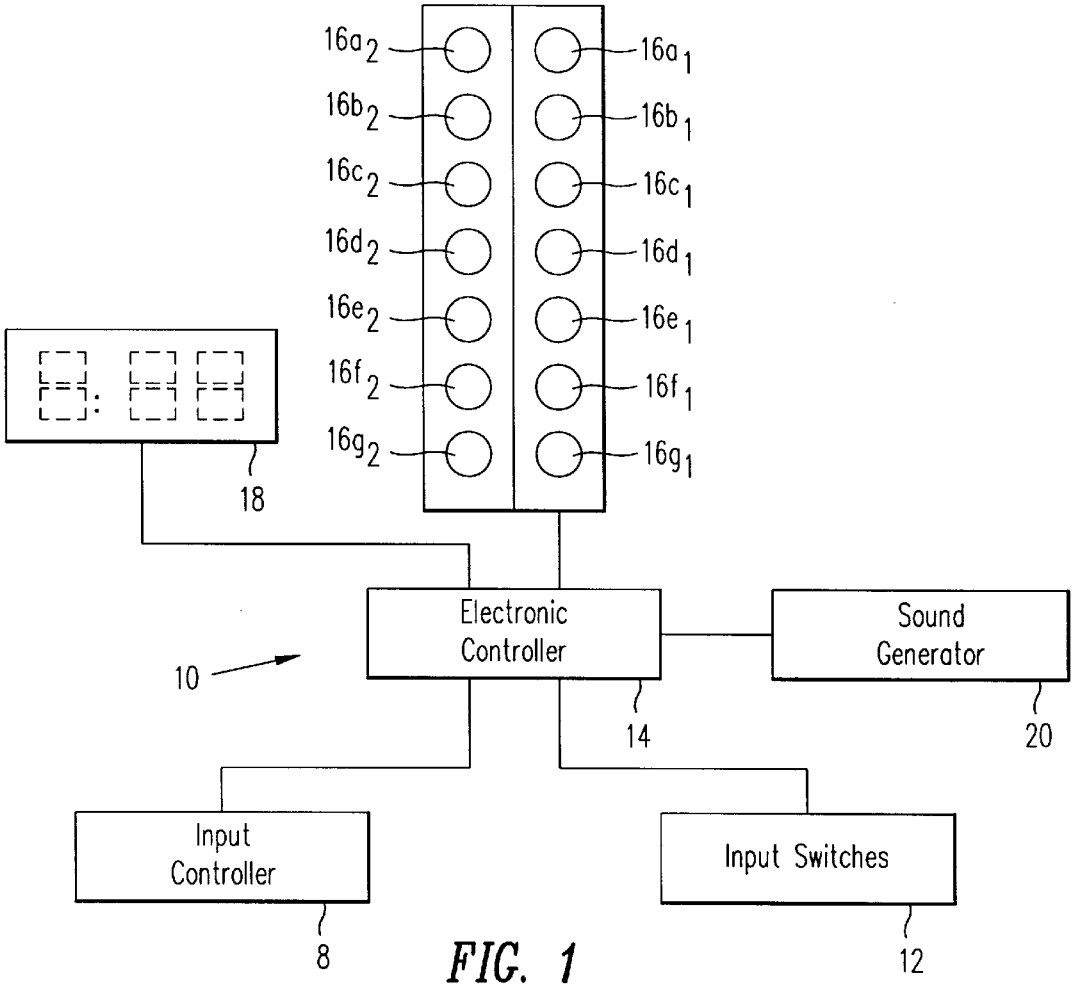
FIG. 1 is a block level diagram of the racing simulation apparatus of the present invention.

Referring to FIGS 1, 1*a*, 1*b*, and 1*c*, there is shown a block level diagram of an automotive racing simulation apparatus 10 of the present invention. The apparatus 10 comprises an input 12 which supplies delay information signals to an electronic controller 14. The apparatus 10 also comprises an input controller 8 for setting the operation of the device 10 into various modes of operation. The electronic controller 14 control a series of paired lights 16(*a*–*g*)(1–2). Each of the lights 16 is individually activatable by the electronic controller 14. The lights consisting of the series 16(*a*–*g*)(1) are visual indicators to simulate the start of racing for one lane and the lights 16(*a*–*g*)(2) are visual indicators to simulate the starting of another lane of an automotive racing field. The electronic controller 14 also controls a plurality of digital display 18. The digital displays 18 can display alphanumeric symbols discernible by the user of the apparatus 10. Finally, the electronic controller 14 controls a sound generator 20. The sound generator 20 generates sound which simulates the automotive racing field. The sound generator 20 can be electrically plugged into the electronic controller 14. Thus, the sound generator 20 can be modularly added to a "Christmas tree" practice racing apparatus.

Figures 1, 2A:
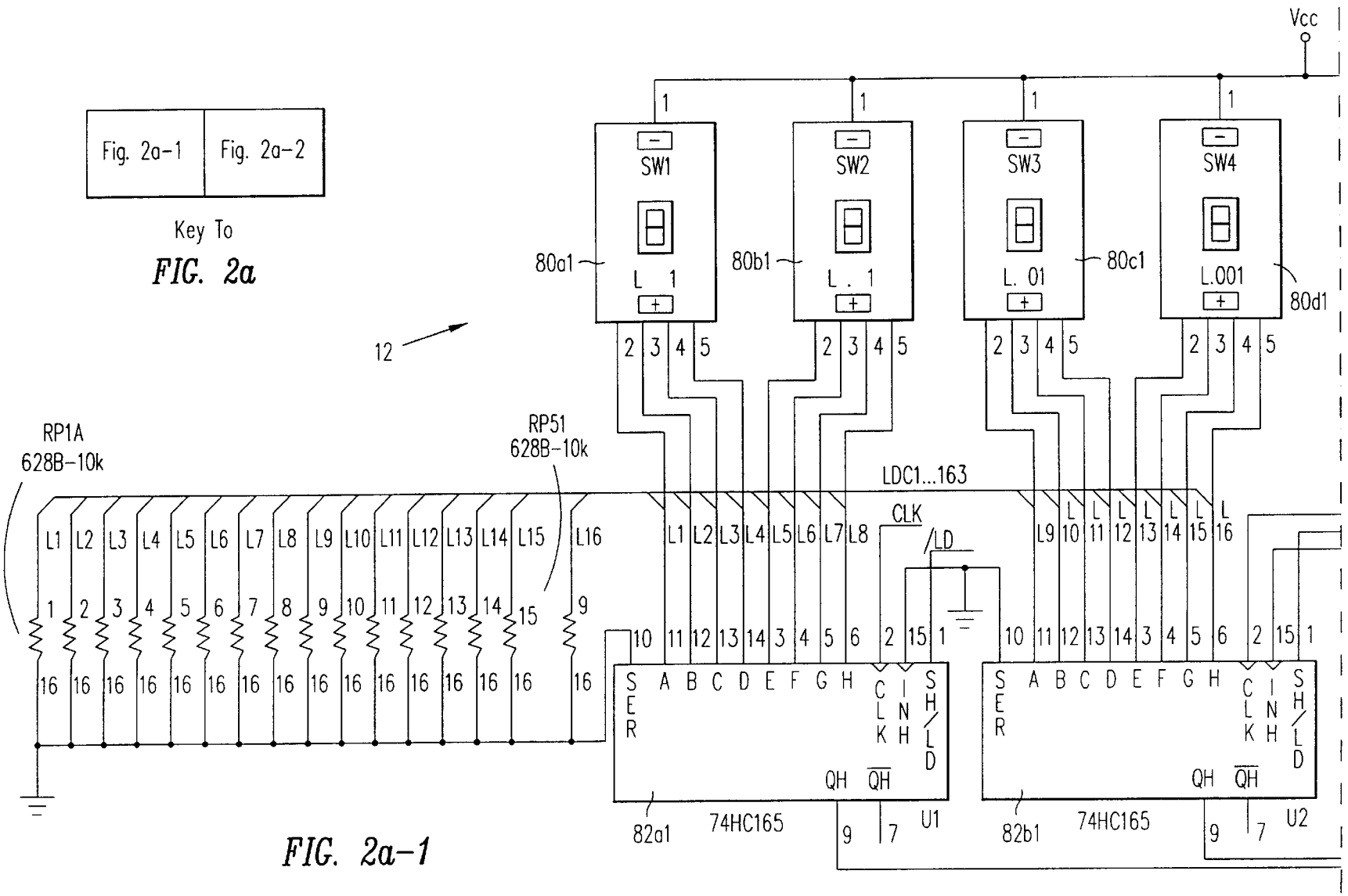
FIG. 2*a* is a key showing how FIGS. 2*a*-1 through 2*a*-2 interrelate.
Figures 2, 2A:
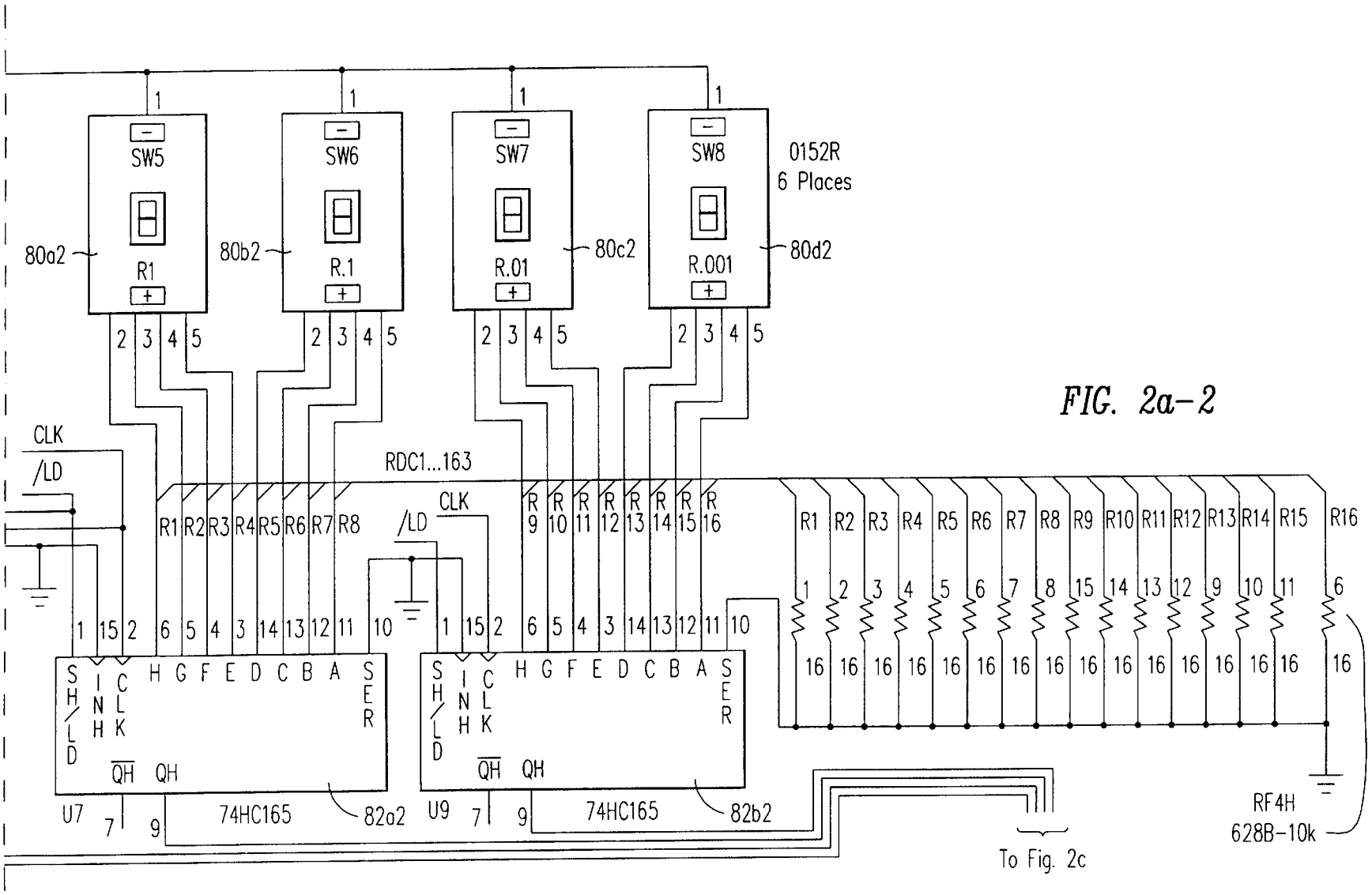

Referring to FIGS. 2*a*, 2*a*-1 and 2*a*-2, there is shown in greater detail the input 12 portion of the apparatus 10 of the present invention. The input 12 comprises a plurality of thumbwheel switches 80(*a*–*d*)(1–2) with four switches 80(*a*–*d*) for each lane. The four switches permit the user to input an amount of delay time. The signals from the switches 80(*a*–*d*)(1–2) are supplied to decoders 82(*a*–*b*)(1–2), respectively. The decoders 82 are standard industry part No. 74HC165.

Figures 1, 2B:
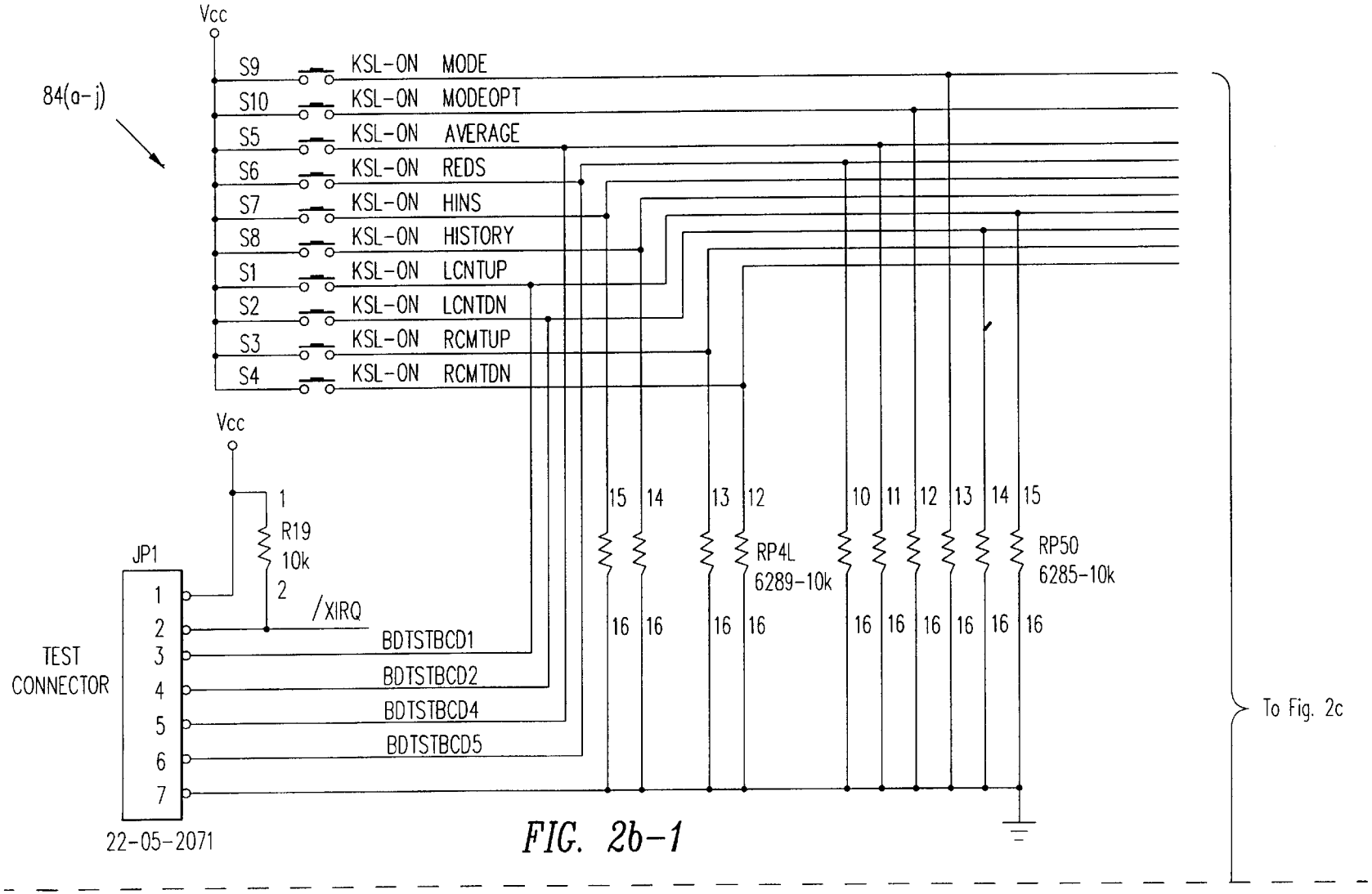
FIG. 2*b* is a key showing how FIGS. 2*b*-1 through 2*b*-2 interrelate.
Figures 2, 2B:
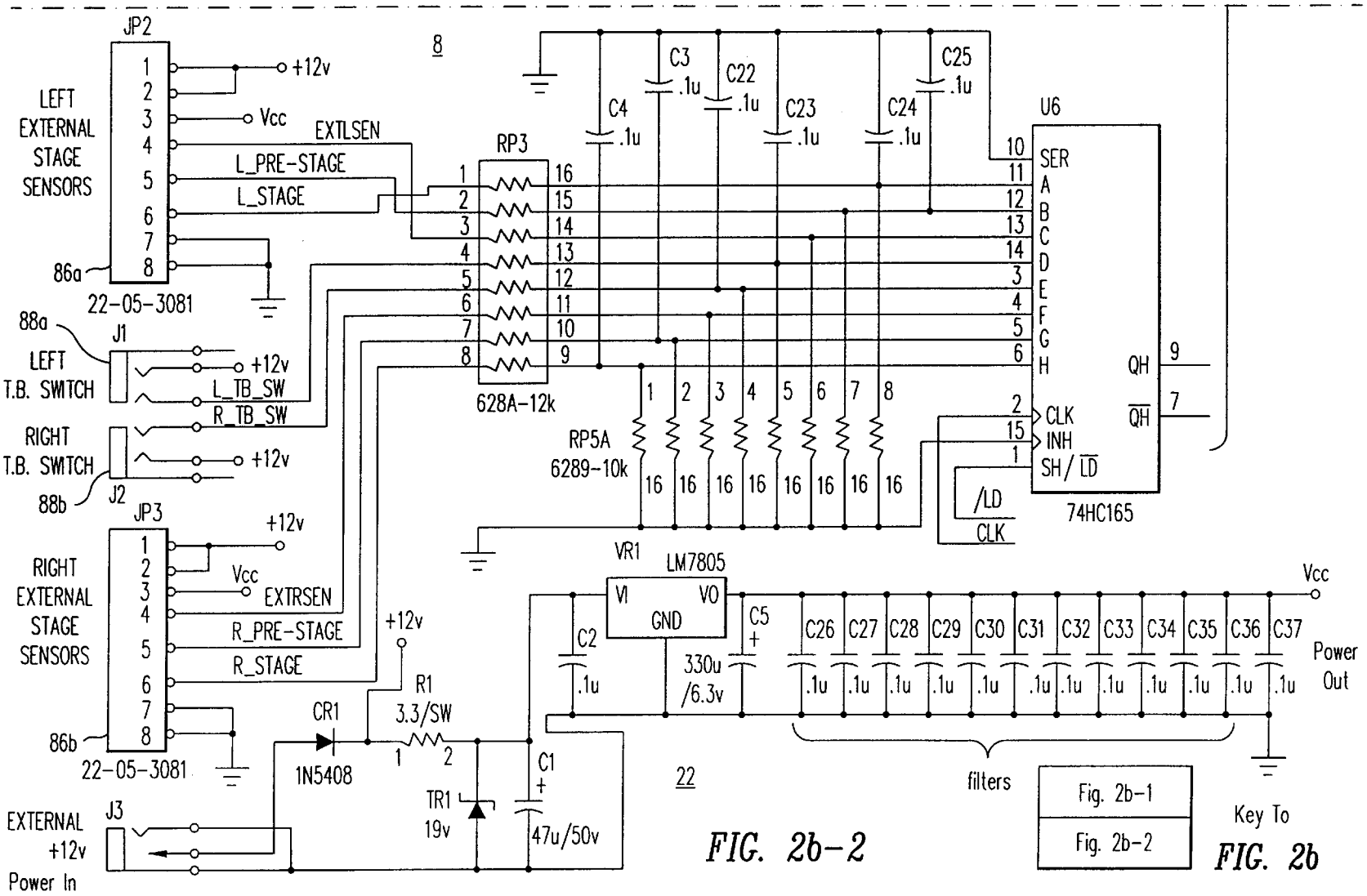

Referring to FIGS. 2*b*, 2*b*-1, and 2*b*-2, there is shown in detail the input controller 8 portion of the device 10. The input controller 8 has a plurality of switches 84(*a*–*j*). The activation of one or more of the switches 84 programs the device 10 to operate in one of a plurality of modes. In one of the modes of operation, the device 10 operates in a conventional delay racing mode. Another mode of operation is cross-over delay operation mode. Other modes of operation include: test, delay box tester, and full tree/pro tree count down (0.5 sec between countdown lights/0.4 sec with all three amber lights activated simultaneously then green).

The input controller 8 also comprises a left and right interfaces 86(*a* & *b*) respectively, for interfacing with photocells for the left and right lanes, respectively. The photo-cells from the left and right lanes are used to simulate the crossing of the photo-cell beams at a race track and to cause the pre-stage and stage lights to be illuminated before starting the countdown lights. Finally, the input controller receives signals from a hand held activation switches (left & right) 88(*a* & *b*) respectively. The hand held activation switches 88 are activated by the user to start a race.

In addition, as shown in FIGS. 2*b*, 2*b*-1 and 2*b*-2, there is a voltage converter 22 of conventional design. The voltage converter 22 receives input voltage for 12 volts and generates as its output thereof five (5) volts, through a series of filters.

Figures 1, 2C:
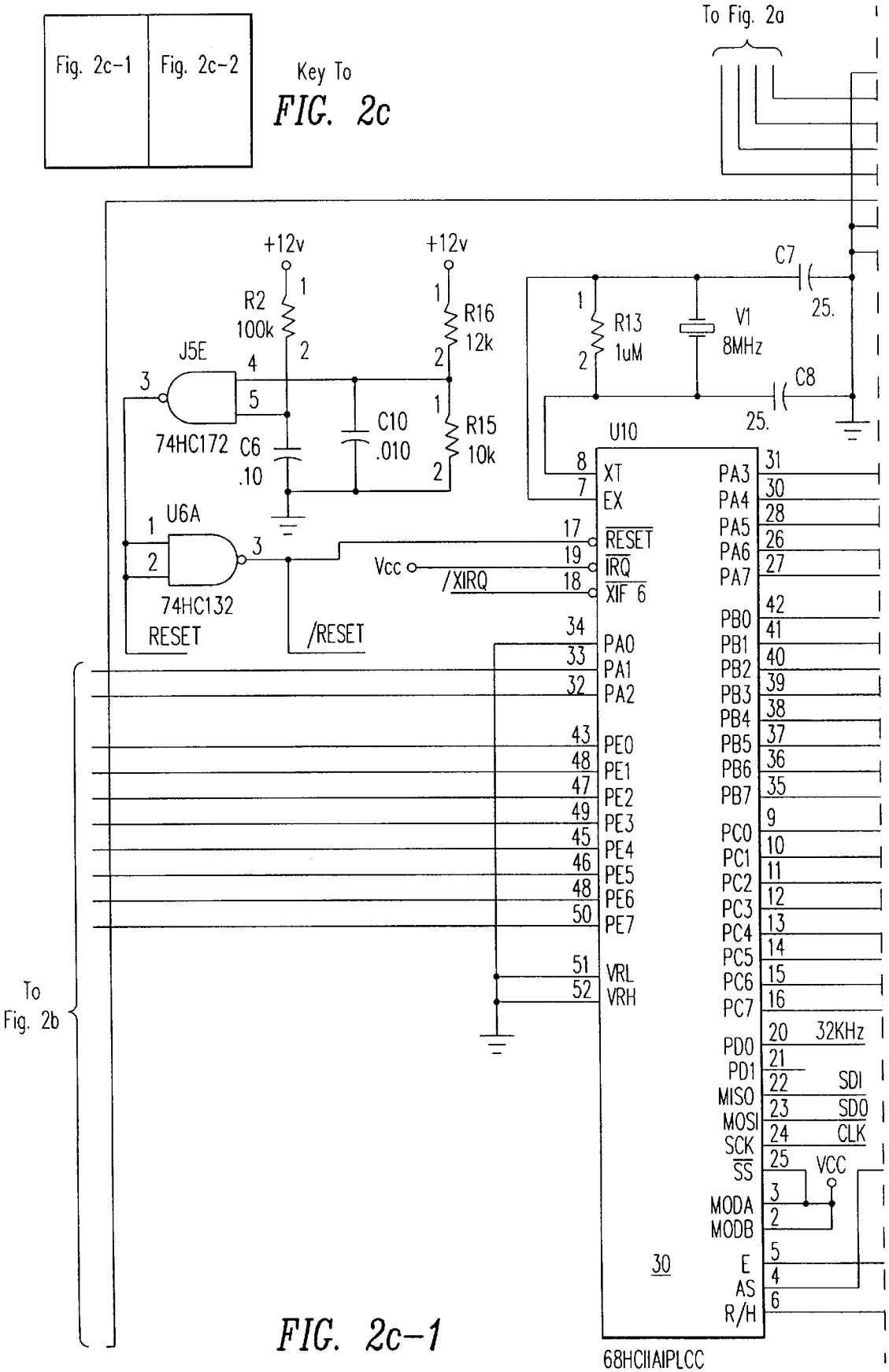
FIG. 2*c* is a key showing how FIGS. 2*c*-1 through 2*c*-2 interrelate.
Figures 2, 2C:
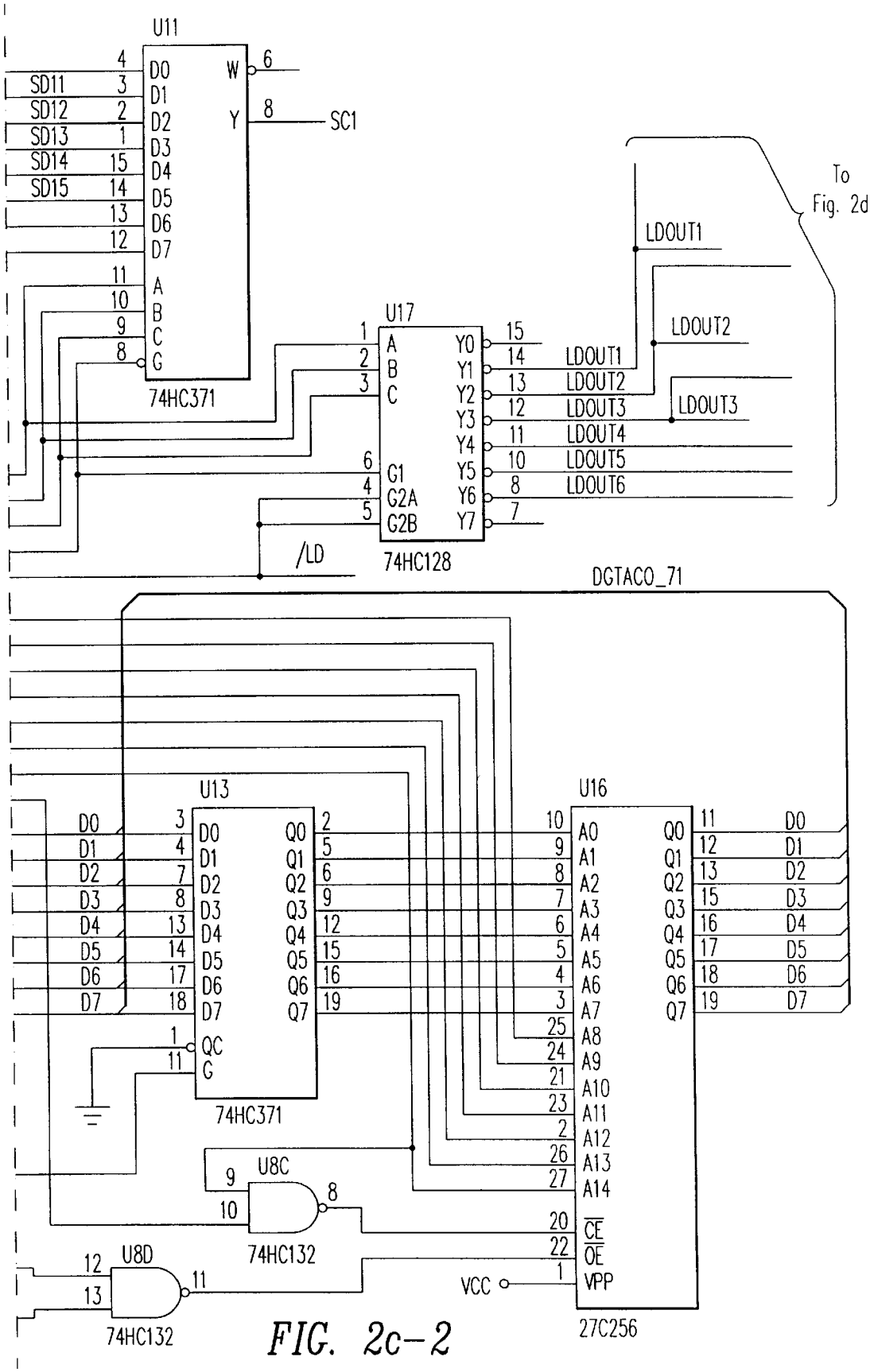
Figures 1, 2D:
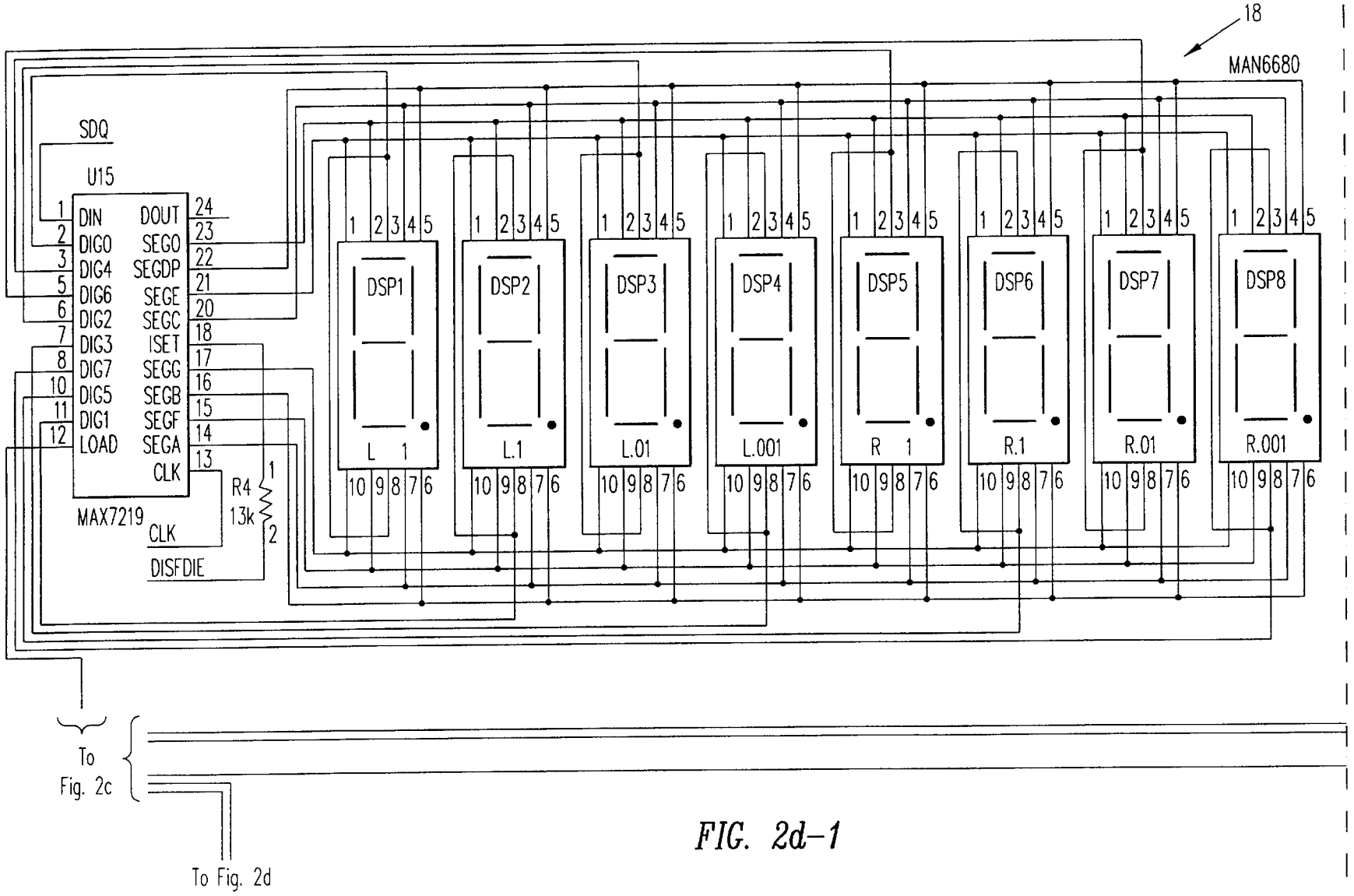
FIG. 2*d* is a key showing how FIGS. 2*d*-1 through 2*d*-3 interrelate.
Figures 2, 2D:
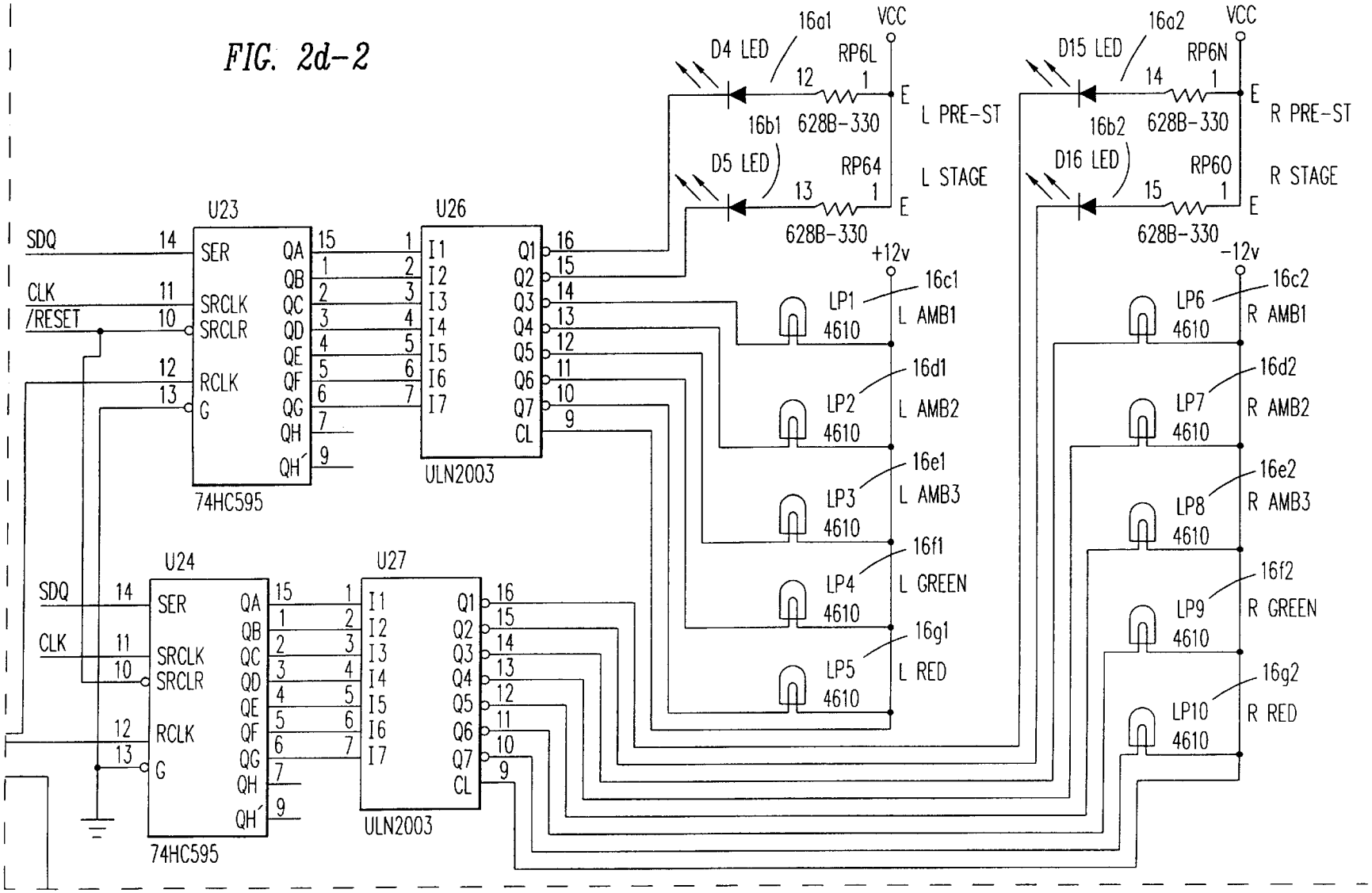
Figures 2, 2D, 3:
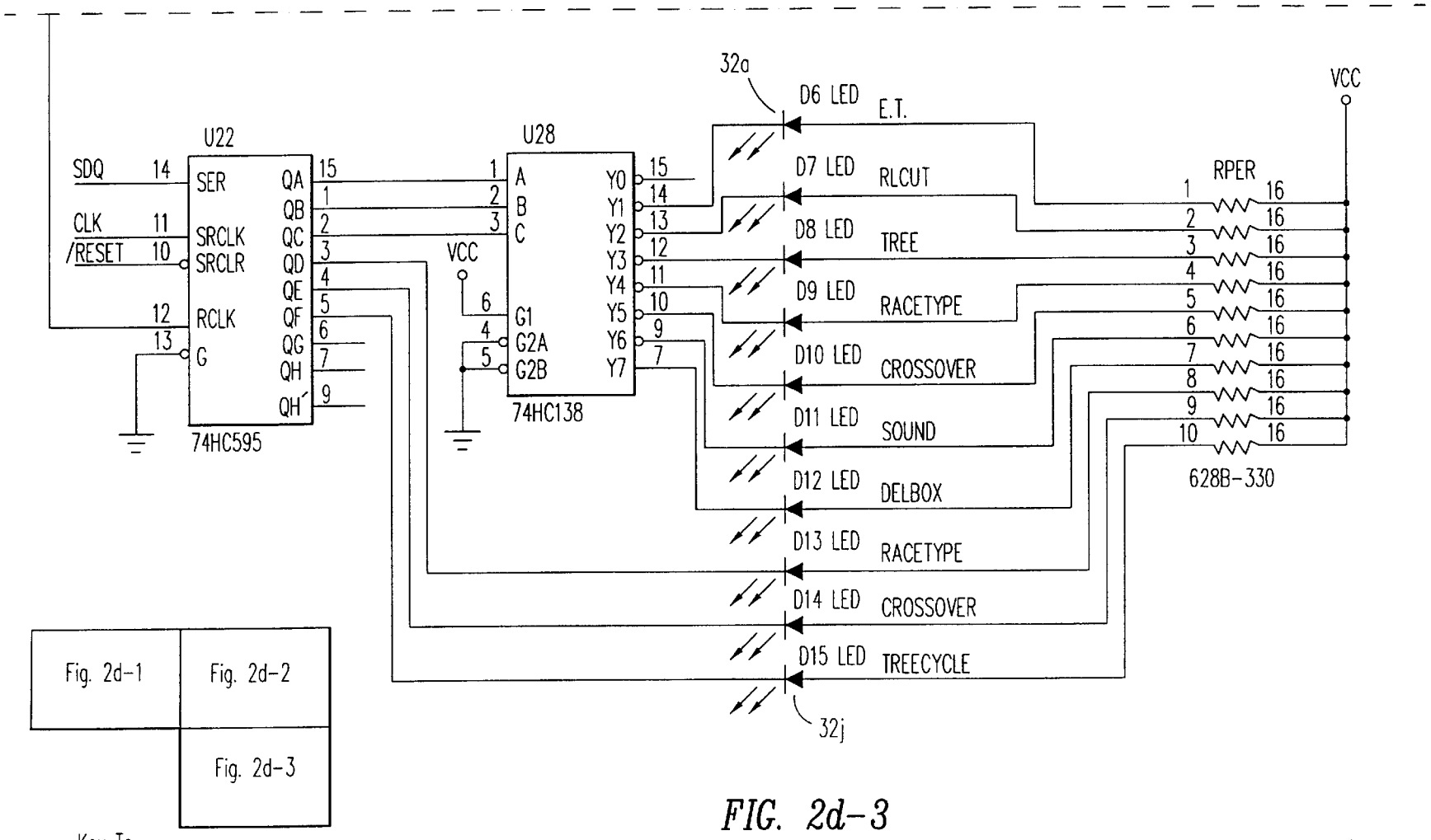

Referring to FIG. 2*c*, 2*c*-1 and 2*c*-2, there is shown a block level diagram of the electronic controller 14. The electronic controller 14 receives the signals from the input 12 and input controller 8, and generates the signals that are supplied to the sound generator 20, the plurality of Christmas trees 16, and the digital readout display 18. In the preferred embodiment, the electronic controller 14 comprises a microcomputer 30 manufactured by Motorola, Inc. designated 68HC22AIPLCC. A flowchart showing the operation of the software for the microcomputer 30 is shown in FIG. 3(*a, b, b*-1, *b*-2, *b*-3, & *b*-4 ).

In addition, the output of the microcomputer 30 is used to control latches 74HC373 which are used to drive bus lines, interfacing with EPROM 27C256, which is used to store the data when the device 10 is turned off.

Figures 1, 2E:
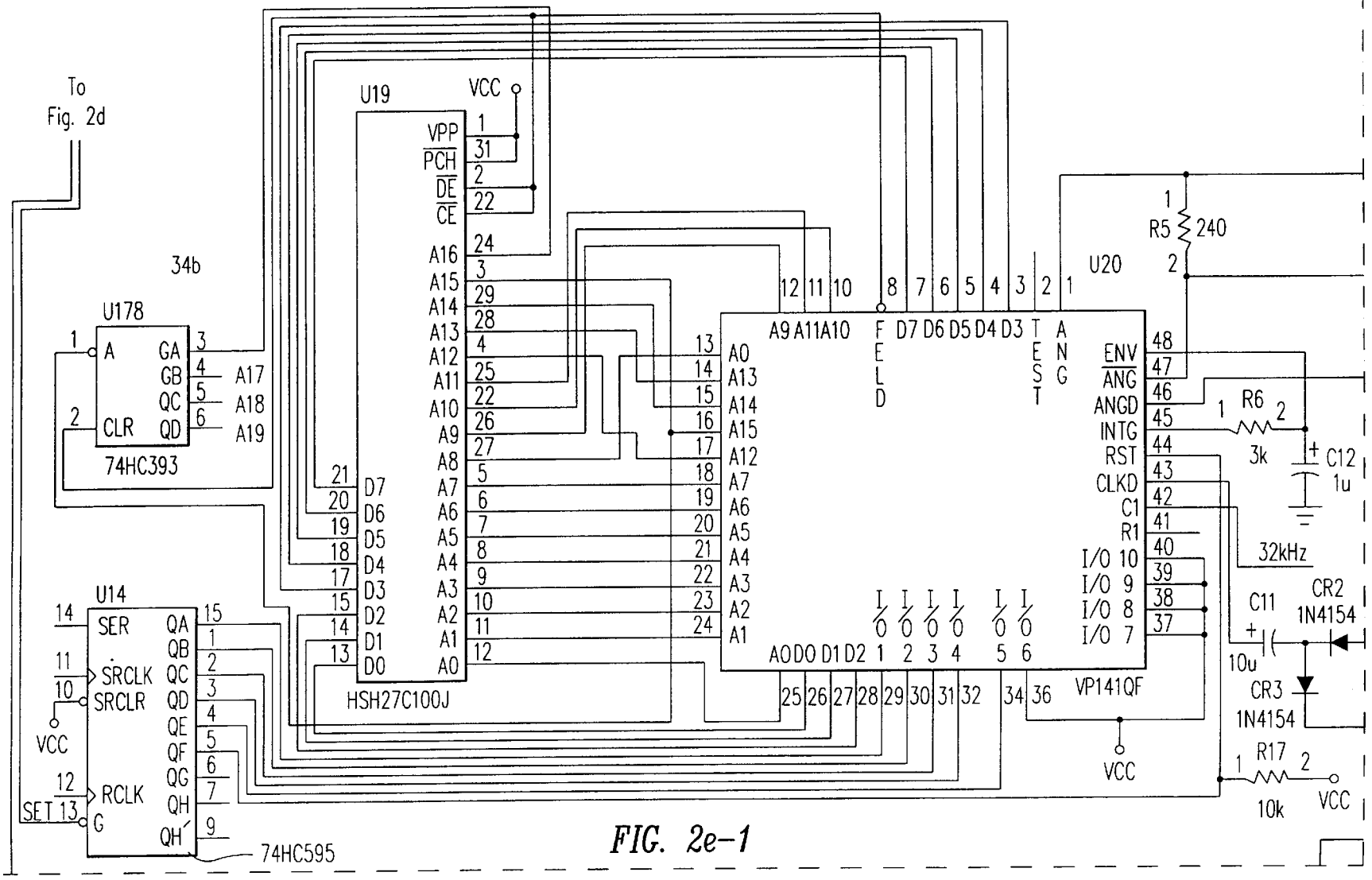
FIG. 2*e* is a key showing how FIGS. 2*e*-1 through 2*e*-3 interrelate.
Figures 2, 2E:
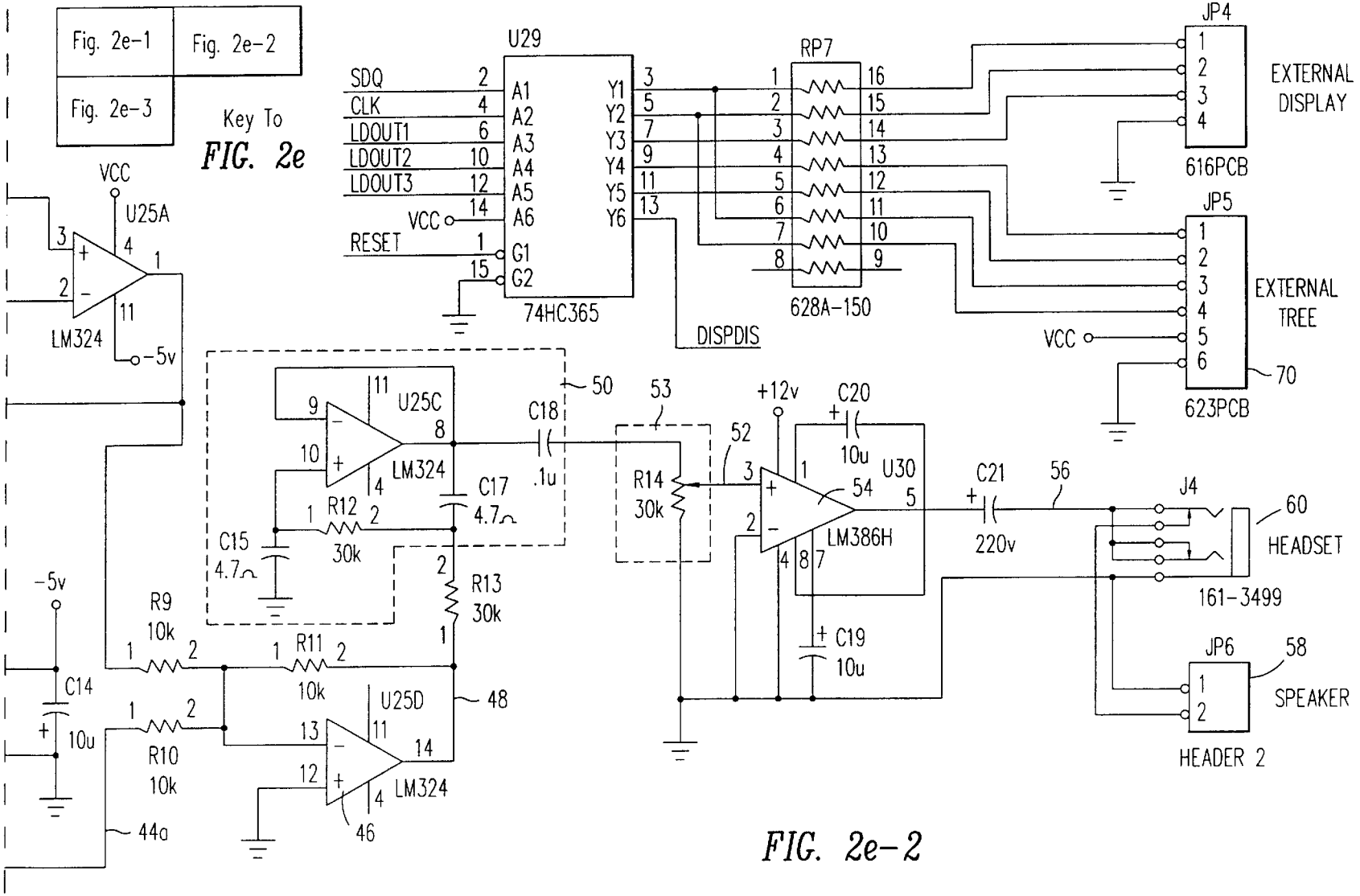
Figures 2, 2E, 3:
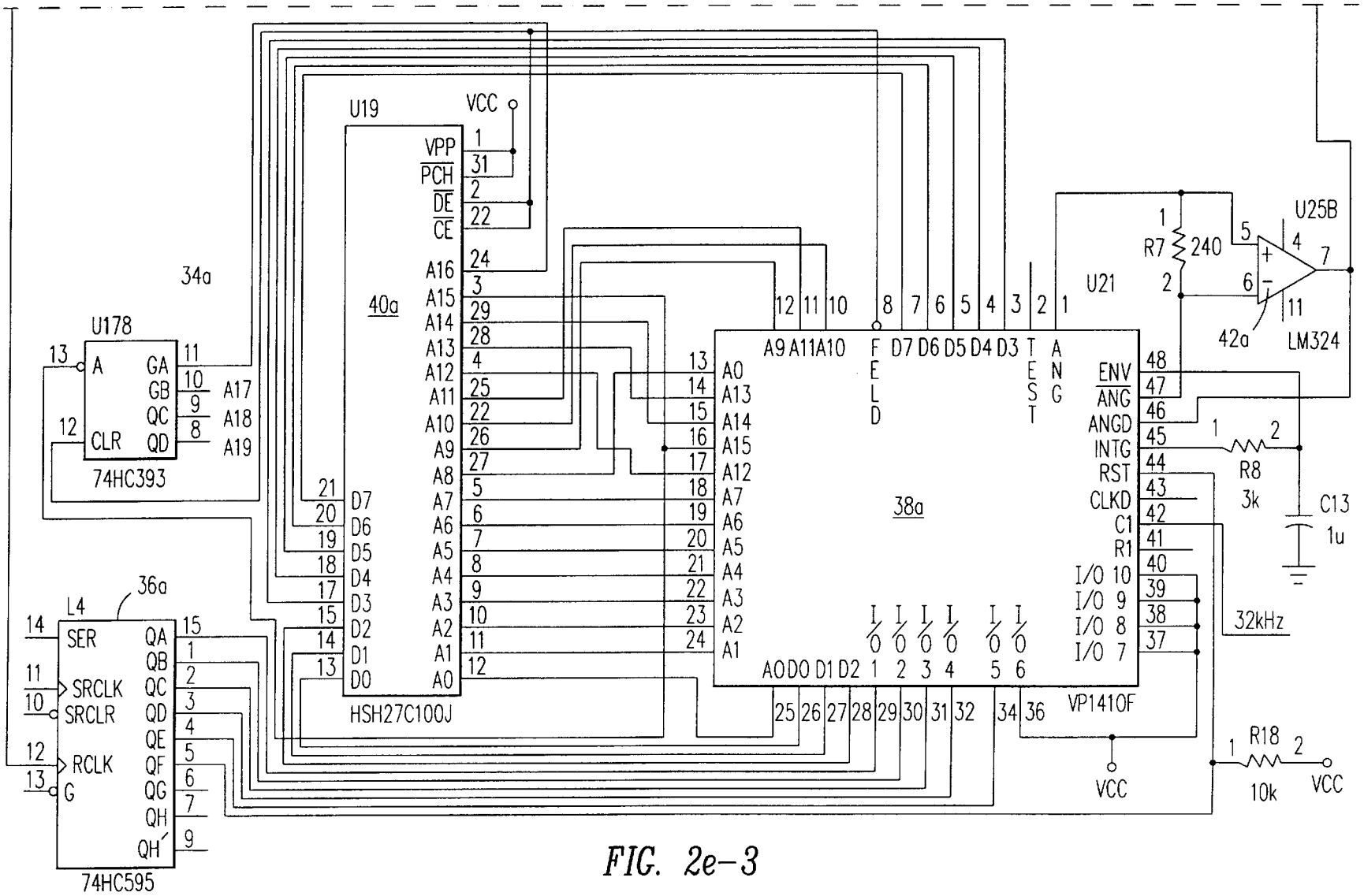
Figure 3A:
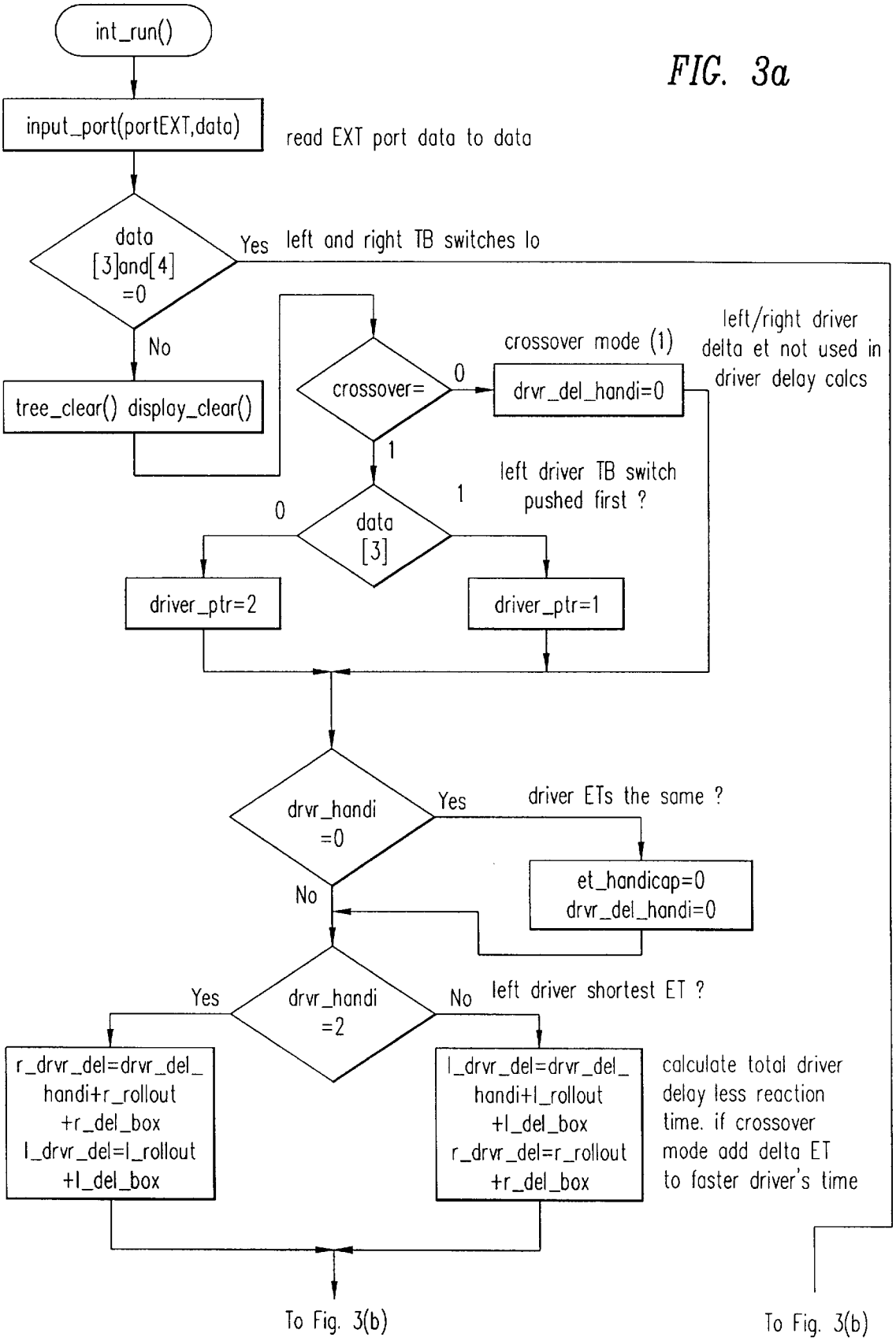
Figures 1, 3B:
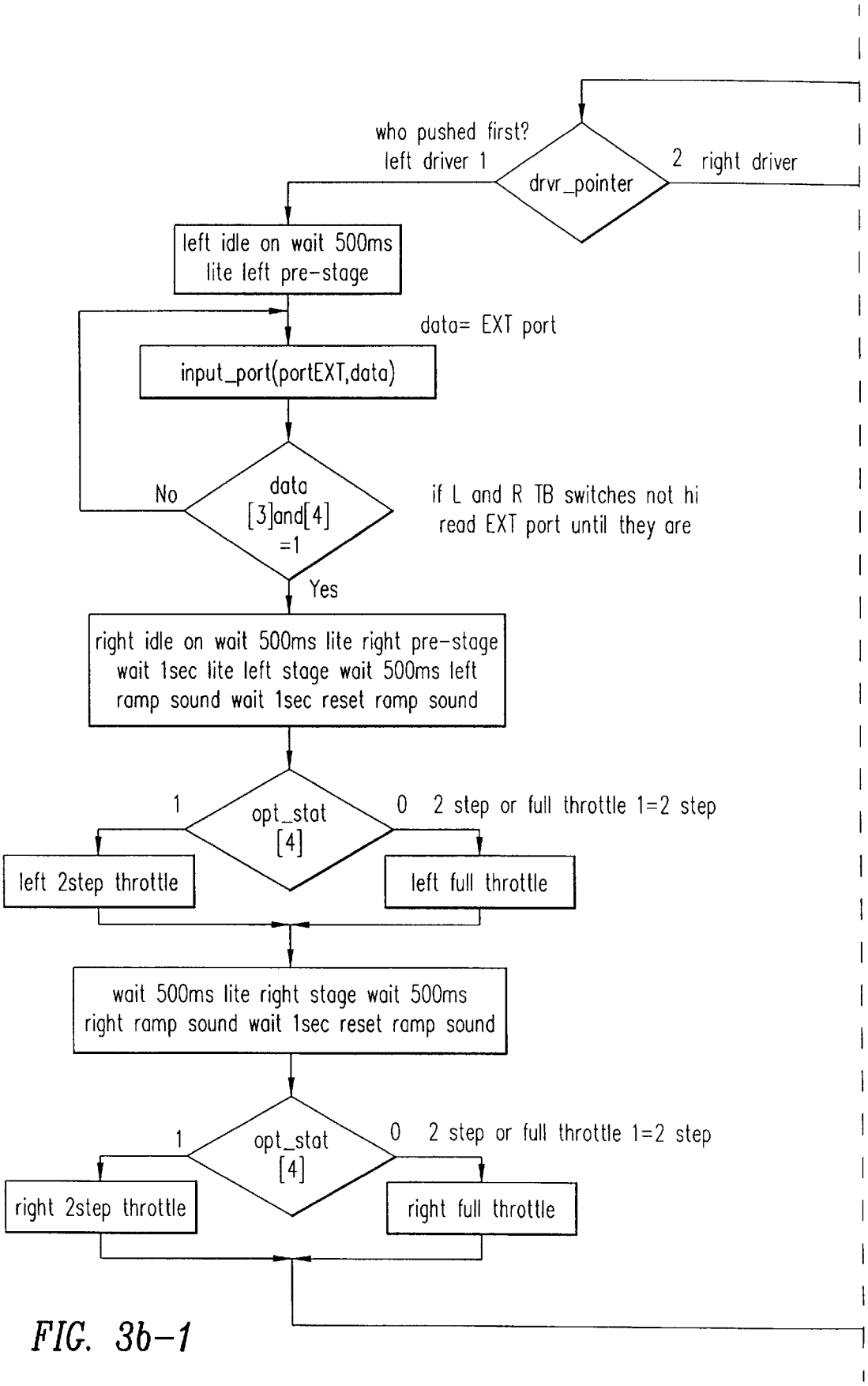
FIG. 3*b* is a key showing how FIGS. 3*b*-1 through 3*b*-4 interrelate.
Figures 2, 3B:
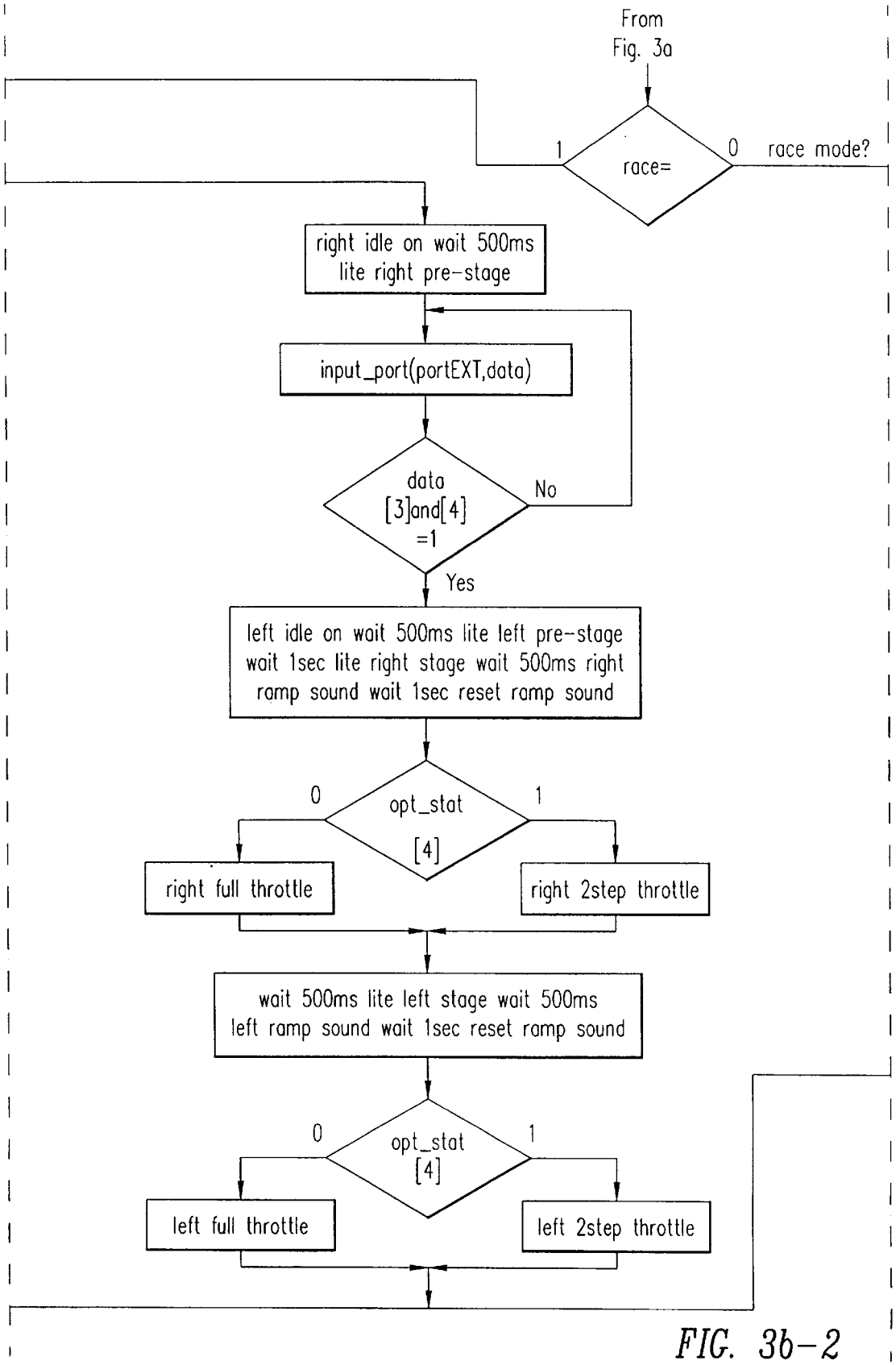
Figures 3, 3B:
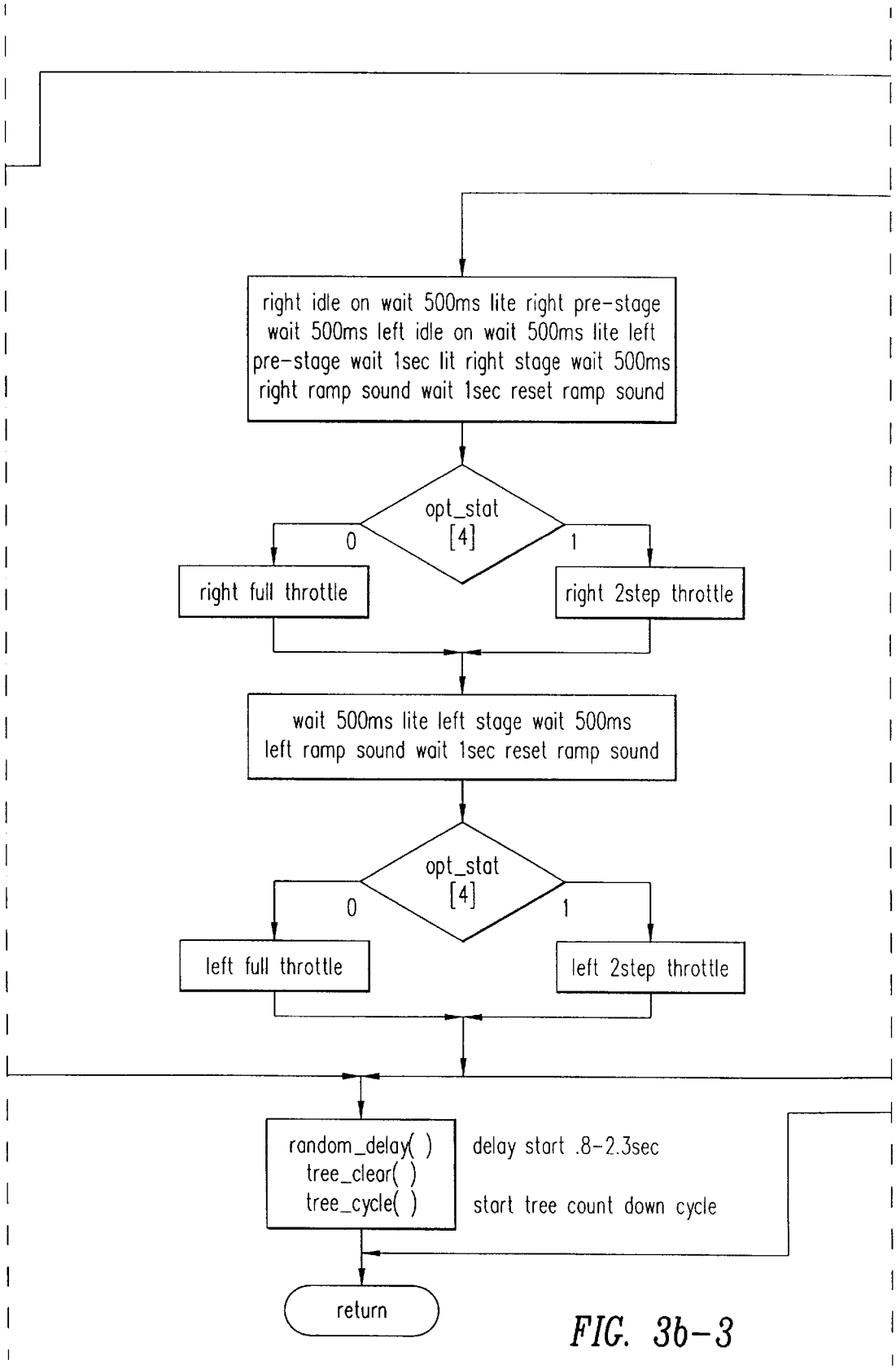
Figures 3, 3B, 4:
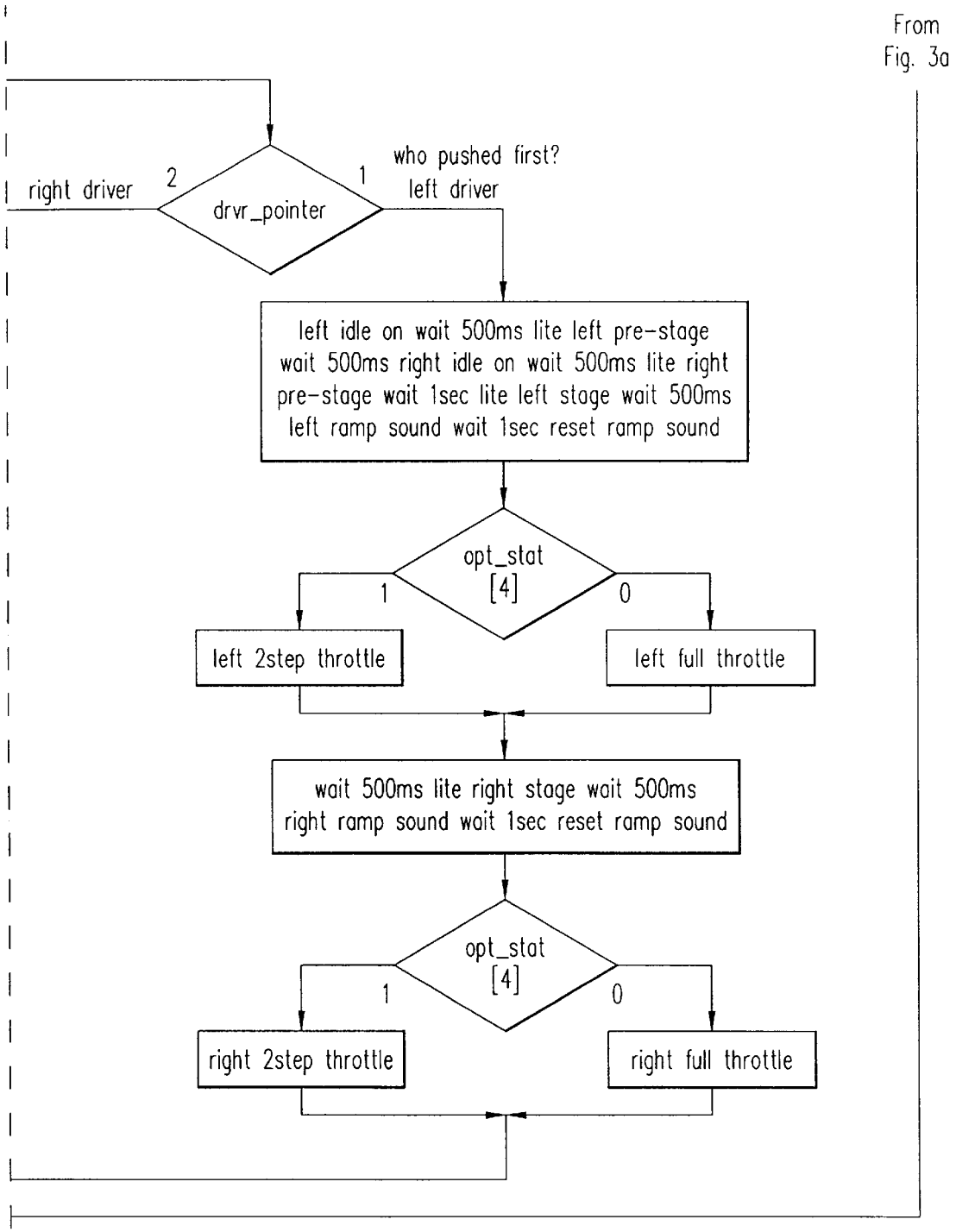

Referring to FIGS. 2*d*, 2*d*-1, 2*d*-2, and 2*d*-3, there is shown in detail the plurality of lights 16(*a*–*g*)(1–2) each of which is individually activatable by the microcomputer 30. The lights 16 consist of a pre-stage light 16(*a*)(1–2), with one for each lane, a stage light 16(*b*)(1–2) with one for each lane, three countdown lights 16(*c–e*)(1–2) (three amber), a start green light 16(*f*)(1–2), and a foul red light 16*g*(1–2). Each of the lights 16 is activatable by the microcomputer 30 through their respective driver 74HC595 and ULN2003. Lights 16(*a–g*)(1) form a visual indication for the start of an automotive race for one lane and light 16(*a–g*)(2) form a plurality of Christmas lights for the visual indication for the start of another lane. The lights 16 may be located proximate to the user, or may be large lights remotely placed connected through an external tree interface 70 shown in FIG. 2*e*-2.

FIG. 2*d*, 2*d*-1, 2*d*-2 and 2*d*-3 also show a plurality of seven (7) segment display means 18 which are activatable by the electronic controller 14 and in particular the microcomputer 30 thereof. In the preferred embodiment, there are eight digits for the display 18 and each of the digits is individually activatable by its respective driver MAX7219 from Maxim Corporation.

Finally, FIGS. 2*d*, 2*d*-1, 2*d*-2 and 2*d*-3 show a plurality of status lights 32(*a–j*), each of which is activatable to indicate the status of the various components of the electronic apparatus 10.

Referring to FIGS. 2*e*, 2*e*-1, 2*e*-2 and 2*e*-3 there is shown in greater detail the sound generator 20 of the apparatus 10 of the present invention. The sound generator 20 comprises two sets of identical circuitry 34*a* and 34*b* each generating sound for one lane. The sound generator 34*a* (or 34*b*) comprises a sound select means 36*a*. In the preferred embodiment this is an IC having an industrial part designation of 74HC595 available from, e.g. Motorola, Inc. The sound select IC 36*a* supplies the signals necessary to control a digital signal processor 38*a*, made by Eletech Electronics, Inc. part number UP-1410. The DSP 38*a* receives sound data which has been stored in digital memory within an EPROM memory MSM27C100J. The digital signals from each of the DSP 38(*a* or *b*) represent sound from each lane and are supplied to an RC filter and are amplified by an amplifier 42 to produce analog signals 44(*a* and *b*). The analog signals 44 (*a* and *b*) are combined by an amplifier 46 to generate a single combined signal 48. This single combined signal 48, however, is a signal on a carrier signal. Thus, the signal 48 is then filtered by filter 50 to produce an audio signal. The filtered audio signal 52 is supplied to a power amplifier circuit 54 which amplifies the filtered audio signal to produce a drive signal 56. The drive signal 56 can be supplied either to speakers through speaker jacks 58 or to headphone jacks 60.

Each of the memories 40(*a–b*) is an EPROM, storing signals representing sound from one lane. In addition, each of the selecting circuits 36*a* provides the user with the ability to alter the digital signal processor 38*a* to select the type of sound indicative of different engines or race track conditions.

In the operation of the apparatus 10 of the present invention, the user can operate the apparatus 10 in one of several modes. In a conventional automotive racing simulation mode, the electronic controller 14 activates the pre-stage and stage lights 16, in response to the activation of switches 88 as if a car had crossed the track into the starting line area. When the electronic controller 14 starts the count down on the visual indicators 16(*a–g*)(1–2) the electronic controller 14 would simultaneously activate the sound generator 20 simulating the roar or the noise of the engine from both lanes. The microcomputer 30 through the selector 36 can "program" the sound generator 20 to generate automotive noises that are different for each lane, e.g. one to indicate the sound of the user's automobile and the other to simulate the sound of a competitor's automobile.

In one embodiment, each lane has five associated sound track segments, used during each simulation of a start of a race. When one of the "users" activates the switch 88, a sound of an "idle" of a vehicle would start. When both "users" have activated the switch 88, the sound of the vehicles "ramping up or accelerating" to full throttle would be generated. This would then be followed by the sound of vehicles running at full throttle either at "normal" or "two-step" (a rev limiter that maintains the engine RPM at a pre-set speed while the car is on the starting line). Finally, when the driver releases switch 88, the sound generated would be of a vehicle making a "run".

The volume for the combined signal can be controlled by varying the potentiometer 53, connected to the power amplifier 54. When the series of indicating lights 16(*a–g*)(1–2) has reached the last amber light of the stage series, then the user hesitates a slight amount and then activates the switch 88, as if to release the brakes on the car allowing the user's car to take off. The electronic controller 14 would then display on display 18 the reaction time or the delay time by which it took the user to proceed after the last amber light of the count down light series is activated, simulating the release of brakes on a car.

As a variation of the foregoing, once the user knows his or her reaction delay time, the user can simulate the operation of the device 10 with a conventional delay box of the type disclosed in U.S. Pat. No. 4,467,219 assigned to the present assignee. The user would first use the thumb wheel switches 80 to input the amount of reaction delay time. As before, the electronic controller 14 controls the series of lights 16(*a–g*)(1–2) at the same time generating the sound by the sound generator 20. As described in U.S. Pat. No. 4,467,219, the user would activate the switch 88 immediately upon perceiving the occurrence of the first of the plurality of countdown lights indicating a count down to the green light. The device 10 would continue to count down normally, but would use the delay time set by the thumb wheel switches 80, upon the last amber light and simulate the start of a vehicle after the delay set on the thumb wheel switches 80 has timed out. The electronic controller 14 would then note the amount of time between the activation of the last amber light 16(*e*) and the receipt of the signal from the timed out delay time set on the thumb wheel switches 80, and display it on display 18. The user would then use this information to further adjust the time delay on the device 10 until, the delay time is almost zero.

Finally, the apparatus 10 of the present invention can be used in a cross-over mode wherein the series of lights 16(*a–g*)(1–2) are activated at different time intervals giving rise to a "handicap". Thus, as a user readies to simulate automotive racing, lights 16(*a–g*)(1) which represent the lights signaling the start on an adjacent competitive automobile may first be activated. The activation of the light 16(*a–g*)(1) would be accompanied by the sound generator 20 generating sound simulating the engine generated by an automobile from the adjacent lane. Furthermore, the sound generator 20 would generate the sound of the automobile actually taking off from the lane prior to the visual lights 16(*a–g*)(2) reaching the green light 16*f*(2). The roar of the adjacent car taking off is an added simulation to the realistic sound of automobile racing which would simulate the conditions at the actual racing track. The controller 14 is programmed in the cross-over mode, so that it will calculate the handicap delay and add it to the delay box setting of the "faster" driver.

Figure 1A:
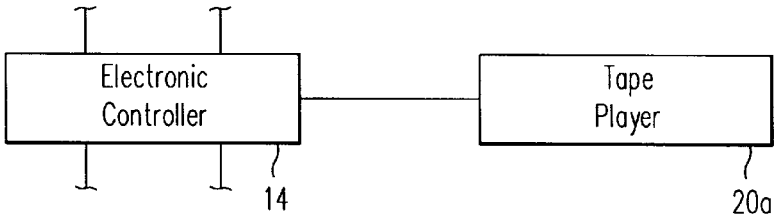
FIGS. 1*a*–1*c* each show a specific alternative embodiment for the sound generator shown in FIG. 1.
Figure 1B:
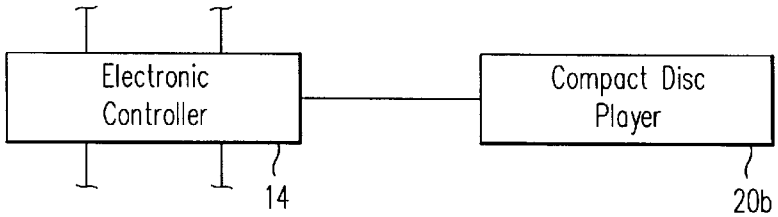
Figure 1C:
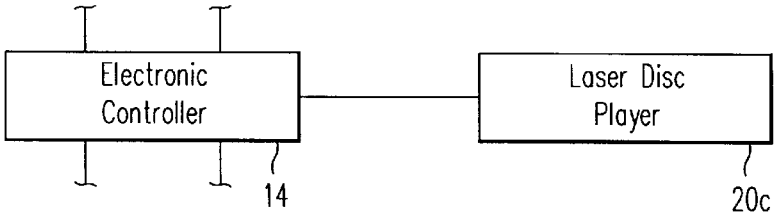

As can be seen from the foregoing, an apparatus to simulate more realistically the start of an automotive racing is disclosed. Apart from the selection of the type of engine and the noise from adjacent competing automobiles, the signals from each of the channels, representing sound from each of the lanes, can be separately controlled and outputted into a conventional stereo system (instead of combining both lanes). Thus, the sound for each lane can be more realistically reproduced. In addition, the apparatus 10 of the present invention can be used in a number of modes, including conventional racing, delay racing and cross-over delay racing, where particularly in the latter case, the racer operates under the condition of "handicap" of waiting while the opponent drives away down the lane generating tremendous amount of noise which interrupts the racer's concentration. In addition, because the visual indicators 16(*a–g*)(1–2) can be large remote mounted displays (typically 100 watt, 5" size), this more realistically simulates a racing condition. The output jacks 70 can send a signal to a remote display that could be mounted near a full size Christmas tree so that the drivers would not have to look down at the practice tree each time. In addition, with an output jack 60 from the apparatus 10 of the present invention, the sound generator 20 can be connected directly to a conventional hi-fi system for further amplification. Finally, and most importantly, the sound generator 20 in the apparatus 10 of the present invention need not be an integrated circuit of semiconductor means. For example, the sound generator 20 can be 20 produced by tape player 20*a*, a CD player 20*b*, or a laser disc player 20*c*, as shown in FIGS. 1*a* through 1*c* respectively, for playing back sound recorded at an actual race. Thus, the apparatus of the present invention more realistically simulates the racing of automobiles.

What is claimed is:

1. A vehicle racing simulation apparatus having a visual indicator means with a plurality of discrete, separately activatable display means for visually indicating the commencement of a vehicle race, said display means including a green or red light for signaling the actual start of the race; electronic means for separately activating each of said display means, in sequence; wherein the improvement comprising:

sound generating means, electrically connectable and detachable to and from said electronic means, for generating sound representative of the vehicle race, prior to its actual start.

2. The apparatus of claim 1, further comprising means for controlling the operation of said racing simulation apparatus in a plurality of modes including activating said sound generating means.

3. The apparatus of claim 1, wherein said sound generating means further comprising:

first digital memory means for storing digitized signals representative of sound of a vehicle race from a first lane, prior to its start; and first digital signal processor (DSP) means for receiving the stored digitized signals from said first digital memory means and for converting said stored digitized signals into a first analog signal.

4. The apparatus of claim 3 wherein said sound generating means further comprising:

second digital memory means for storing digitized signals representative of sound of a vehicle race from a second lane, prior to its start; and second digital signal processor (DSP) means for receiving the stored digitized signals from said first digital memory means and for converting said stored digitized signals into a second analog signal.

5. The apparatus of claim 4 wherein said sound generating means further comprising:

means for combining said first and second analog signals to form a combined signal; and means for filtering and amplifying said combined signal.

6. The apparatus of claim 5 further comprising means for controlling the amplitude of said combined signal.

7. The apparatus of claim 1 wherein said sound generating means further comprising tape playback means.

8. The apparatus of claim 1 wherein said sound generating means further comprising CD playback means.

9. The apparatus of claim 1 wherein said sound generating means further comprising laser disc playback means.

10. The apparatus of claim 1 further comprising:

user selectable means for selecting sound representative of the type of engine sound of the vehicle race desired.

11. The apparatus of claim 2 wherein one of said plurality of modes of operation is cross over delay racing.

12. The apparatus of claim 11 wherein said electronic means is responsive to said user activatable means to delay automatically one of said two lanes.

13. The apparatus of claim 1 further comprising means for displaying the reaction time of a driver.

14. The apparatus of claim 10 wherein said displaying means is remotely mounted.

* * * * *